US006122873A

United States Patent [19]

Randjelovic

[11] Patent Number: 6,122,873

[45] Date of Patent: Sep. 26, 2000

[54] SUBFLOOR ASSEMBLY FOR ATHLETIC PLAYING SURFACE HAVING IMPROVED DEFLECTION CHARACTERISTICS

[75] Inventor: Erlin A. Randjelovic, Crystal Falls, Mich.

[73] Assignee: Connor/AGA Sports Flooring Corporation, Amasa, Mich.

[21] Appl. No.: 09/097,077

[22] Filed: Jun. 12, 1998

[51] Int. Cl.[7] ..... E04F 15/22

[52] U.S. Cl. ..... 52/403.1; 52/391; 52/480

[58] Field of Search ..... 52/403.1, 480, 52/391

[56] References Cited

U.S. PATENT DOCUMENTS

| | | | |
|---|---|---|---|
| 498,344 | 5/1893 | Williams . | |
| 802,622 | 10/1905 | Van Den Bulcke . | |
| 1,195,289 | 8/1916 | Stevens . | |
| 1,302,578 | 5/1919 | Murphy . | |
| 1,339,425 | 5/1920 | Stevens . | |
| 1,342,610 | 6/1920 | Wheeler . | |
| 1,343,234 | 6/1920 | Stevens . | |
| 1,350,349 | 8/1920 | Walther . | |
| 1,491,198 | 4/1924 | Cassidy . | |
| 1,587,355 | 6/1926 | Raun . | |
| 1,668,842 | 5/1928 | Dudfield et al. . | |
| 1,692,855 | 11/1928 | Murphy . | |
| 1,693,655 | 12/1928 | Murphy . | |
| 1,752,583 | 4/1930 | Wright . | |
| 1,781,117 | 11/1930 | Mackie et al. . | |
| 1,787,067 | 12/1930 | Eisler . | |
| 1,911,433 | 5/1933 | Cinnamond . | |
| 1,977,496 | 10/1934 | Snyder et al. . | |
| 2,066,005 | 12/1936 | Jenkins . | |
| 2,167,836 | 8/1939 | Greulich . | |
| 2,414,986 | 1/1947 | Tinnerman . | |
| 2,708,781 | 5/1955 | McMullan . | |
| 2,862,255 | 12/1958 | Nelson . | |
| 2,996,160 | 8/1961 | Voight . | |
| 3,045,294 | 7/1962 | Livezey, Jr. . | |
| 3,114,940 | 12/1963 | Rockbrand et al. | 52/403.1 X |
| 3,271,916 | 9/1966 | Omholt . | |
| 3,387,422 | 6/1968 | Wanzer . | |
| 3,398,491 | 8/1968 | Babcock . | |
| 3,518,800 | 7/1970 | Tank . | |
| 3,562,990 | 2/1971 | Boettcher . | |
| 3,566,569 | 3/1971 | Coke et al. . | |
| 3,596,422 | 8/1971 | Boettcher . | |
| 3,786,608 | 1/1974 | Boettcher . | |
| 3,788,021 | 1/1974 | Hüsler . | |
| 4,170,859 | 10/1979 | Counihan . | |
| 4,599,842 | 7/1986 | Counihan . | |
| 4,819,932 | 4/1989 | Trotter, Jr. . | |
| 4,831,806 | 5/1989 | Niese et al. . | |
| 4,856,250 | 8/1989 | Gronau et al. . | |
| 4,879,856 | 11/1989 | Jones et al. . | |
| 4,879,857 | 11/1989 | Peterson et al. . | |
| 4,890,434 | 1/1990 | Niese . | |
| 4,930,280 | 6/1990 | Abendroth . | |
| 5,016,413 | 5/1991 | Counihan . | |
| 5,369,710 | 11/1994 | Asai . | |
| 5,369,927 | 12/1994 | Counihan . | |
| 5,377,471 | 1/1995 | Niese . | |
| 5,388,380 | 2/1995 | Niese . | |
| 5,475,959 | 12/1995 | Mackenzie . | |
| 5,497,590 | 3/1996 | Counihan . | |
| 5,609,000 | 3/1997 | Niese | 42/403.1 X |
| 5,647,183 | 7/1997 | Counihan . | |
| 5,778,621 | 7/1998 | Randjelovic . | |
| 5,906,082 | 5/1999 | Counihan | 52/403.1 |

FOREIGN PATENT DOCUMENTS

| | | |
|---|---|---|
| 53863 | 11/1937 | Denmark . |
| 106748 | 1/1899 | Germany . |

*Primary Examiner*—Robert Canfield
*Attorney, Agent, or Firm*—Merchant & Gould P.C.

[57] ABSTRACT

The invention includes a subfloor assembly for supporting a floor surface on a substrate. The subfloor assembly includes a plurality of plate members extending in parallel relation along the substrate, with a space formed between adjacent plate members. A plurality of sleeper members extending longitudinally along the substrate, and are located in the spaces between adjacent plate members. First resilient members are positioned on the upper surface of each of said plate members, and second resilient members are positioned below the lower surface of each of said sleeper members.

The floor surface is attached to an upper surface of said sleeper members. The second resilient members are preferably more compressible than the first resilient members. The subfloor assembly also preferable has a plurality of brackets that limit upper movement of the sleeper members but permit downward movement of the sleeper members.

51 Claims, 6 Drawing Sheets

SUBFLOOR ASSEMBLY FOR ATHLETIC PLAYING SURFACE HAVING IMPROVED DEFLECTION CHARACTERISTICS

TECHNICAL FIELD

This invention generally relates to a subfloor assembly which is constructed to support a top sports floor surface. More specifically the subfloor construction is designed to provide high resiliency and to isolate athletic impacts on the sports floor surface. The invention further provides significant stability to maintain constant uniformity of play.

BACKGROUND

Preferred sports floors provide a high level of resiliency and shock absorption, and also preferably provide uniform play and safety to all participants. It is also preferred that sports floor systems maintain stability especially under changing environmental conditions.

A common sports floor system can be described as an upper playing surface attached to a subfloor structure, which is supported by resilient mounts. Often the upper playing surface is constructed of hardwood flooring. Sports floor systems such as these are disclosed in U.S. Pat. Nos. 4,879,875 to Peterson et al and 5,369,710 to Randjelovic et al.

The resilient mounts such as those described in the Peterson and Randjelovic patents are widely used in support of subfloor construction. The resilient mounts provide deflection as athletic impacts occur on the surface of the system. Most typically the resilient mounts are attached to the underside of subfloor panels such as plywood sheeting. The subfloor structure supported by the resilient mounts is not limited to plywood panel components and may include other components such as softwood sleepers or other suitable support material.

The sports floor systems previously described offer shock absorption to athletic participants. However, as these floor systems are free floating, there is no provision to assure proper contact of the resilient mounts to the supporting substrate. Free floating systems such as these, when installed over uneven substrates, may provide non-uniform deflection under athletic load, causing uneven shock absorption under impact. Also, the non-uniform reflection of the basketball off the floor creates a condition typically referred to as dead spots.

Further, free-floating systems are sometimes significantly affected by environmental conditions. Expansion of the wooden surface or subfloor typically occurs as high airborne humidity is absorbed into the wood, increasing the flooring moisture content. As wood moisture content increases, the flooring strip sometimes expands to create vertical pressure on floating sports floor systems resulting in what is commonly referred to as buckling. This occurrence creates a number of performance problems including inconsistent response to athletic and basketball impacts and especially safety concerns.

An alternative to free floating sports floor construction is the anchored sports floor systems. Examples of anchored sports floors are disclosed in U.S. Pat. No. 3,518,800 to Tank et al and U.S. Pat. No. 3,566,569 to Coke et al. The Tank patent includes specially manufactured metal clips to secure hardwood flooring strips to steel channels which are mechanically fastened to the concrete substrate. The Coke patent provides wooden nailing strips for attachment of hardwood flooring by nailing or stapling. The nailing strips are encased in steel channels mechanically fastened to the concrete substrate in the same manner as the steel channel in the Tank design.

Anchored systems provide integrity when fastening the subfloor steel channels to the supporting substrate. These systems also provide uniform play with consistent contact to the substrate regardless of undulations in the substrate surface. Anchored sports floor systems also maintain significant stability and buckle resistance under environmental conditions which can negatively affect free-floating sports floors.

However, unlike free-floating systems the anchored systems do not provide any significant degree of shock absorption and resiliency under athletic impacts. Providing shock absorption under athletic activities requires deflection of the floor system under load impacts such as when running, jumping or landing. The proper anchorage of floor systems such as those described in the Tank and Coke patents requires that the steel channel is secured to the concrete in a manner which allows very little deflection under athletic loads. It is known in the sports floor industry that minimal deflection must be maintained in anchored channel systems to prevent significant squeaking in these floor systems even under light athletic loads such as running, jogging or walking across the floor surface.

Sports floor systems such as U.S. Pat. No. 4,856,250 to Gronau et al and U.S. Pat. No. 5,016,413 to Counihan et al have been designed in an effort to obtain the advantages of both floating and anchored construction. These systems are typically referred to as resilient anchored sports floors. The Gronau and Counihan designs include structure, such as a steel channel, which allows downward deflection under athletic impacts while maintaining resistance to upward pressure such as those created by environmental influences as previously described.

The steel channel in both the Gronau and Counihan design is provided in manner which is intended to remain stationary regardless of downward movement of the floor systems. This feature prevents the possibility of squeaks which sometimes occur on typical anchored systems where the steel channel rubs against the anchoring pin when the system deflects. As with typical anchored systems, resilient anchored floors are intended to provide continuous contact to the substrate, thereby providing a higher level of consistency for shock absorption and ball reflection.

In systems made according to the Gronau and Counihan patents, the sleepers bear substantially all of the load applied to the floor surface. Moreover, these systems generally require a subfloor layer above the sleepers and below the floor surface. For these reasons, these resilient anchored systems do not provide ideal uniformity and reactions to impact.

In addition, substantial effort has been made in recent years to provide sports floor designs which control the width of deflection of the floor surface under athletic impacts. Such designs are intended to allow uninterrupted shock absorption for athletes performing in close proximity to each other. Athletic activities such as basketball and volleyball often cause participants to perform in close contact with other athletes during competition. This is especially true below the basketball backboard and along the volleyball net. Floor systems which allow a broad area of deflection under individual athletic impacts greatly reduce available deflection and consequently shock absorption for nearby participants.

Sports floor systems have been designed in an attempt to control the area of deflection under athletic impacts. An example of such a design is disclosed in U.S. Pat. No. 4,890,434 to Niese et al. The Niese design includes designated saw cuts in the underside of the subfloor sheeting and flooring material in an effort to control deflection. This design, as well as other subfloor configurations, provides greater flex in the floor system in an effort to specifically control the area of deflection under surface impacts.

Containment of impacts can be measured through testing, using the International Standard DIN 18032 part 2 for athletic sports surfaces. This standard is commonly used and specified for acceptable sports floor systems throughout the world. A measurement referred to as W500 is included in the DIN 18032 part 2 standard. This measurement is used to determine the deflection of the floor system at 500 mm from the point of impact on the floor surface. This test criteria allows evaluation of the floor systems ability to provide safety functions for individuals performing in close proximity to each other.

The W500 test standards have recently been changed to make them more restrictive. It is believed that the systems discussed above will not be able to meet these more restrictive deflection tests.

SUMMARY OF THE INVENTION

The invention includes a subfloor assembly for supporting a floor surface on a substrate. The subfloor assembly includes a plurality of plate members extending in parallel relation along the substrate, with a space formed between adjacent plate members. A plurality of sleeper members extending longitudinally along the substrate, and are located in the spaces between adjacent plate members. First resilient members are positioned on the upper surface of each of said plate members, and second resilient members are positioned below the lower surface of each of said sleeper members. The floor surface is attached to an upper surface of said sleeper members.

The second resilient members are preferably more compressible than the first resilient members. As a result, when loads are applied to the athlectic surface, the sleeper members deform easily, and the majority of the force is absorbed by the first resilient members. This allows the system to be more responsive to impacts and to limit the area of deflection of the floor.

The subfloor assembly also preferably has a plurality of brackets that limit upper movement of the sleeper members but permit downward movement of the sleeper members. These brackets may have a portion which is inserted into slots formed in a side surface of the plate members so as to hold the brackets in a fixed position. Subfloor anchors are preferably provided to assure proper contact between the plate members and the supporting substrate. The brackets provide stability under adverse environmental conditions, while the resilient members provide superior shock absorption for athletic functions when participants impact the floor system, even in close proximity to one another.

DETAILED DESCRIPTION OF THE PREFERRED EMBODIMENTS

Figure 1:
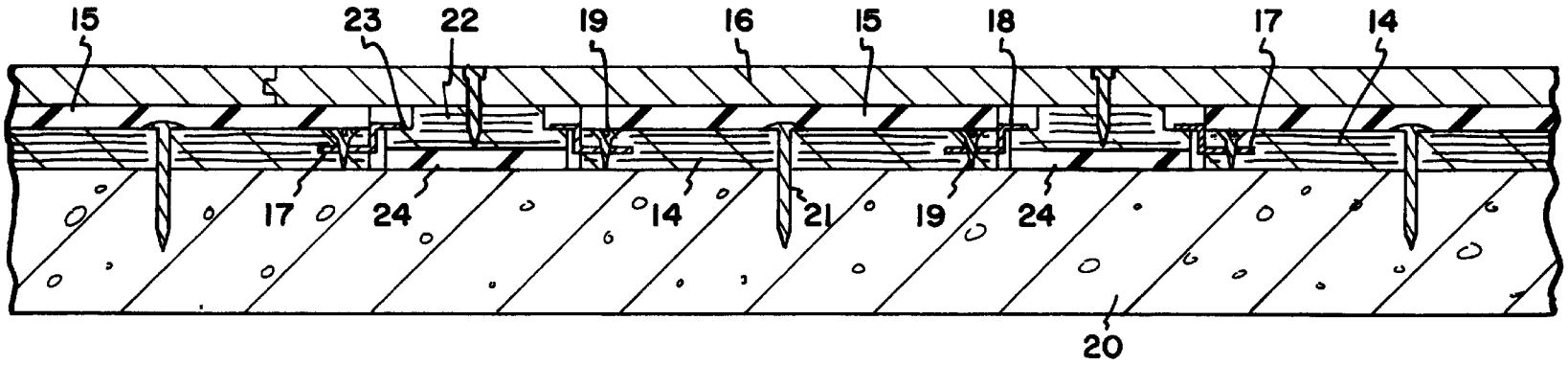
FIG. 1 is a sectional view of a portion of a floor system employing a subfloor made according to a first preferred embodiment of the present invention.

Preferred embodiments of the invention will be described in detail with reference to the drawings, wherein like reference numerals represent like parts and assemblies throughout the several views. Reference to the preferred embodiments does not limit the scope of the invention, which is limited only by the scope of the claims attached hereto.

In general, the present invention relates to a subfloor for placement below an upper floor surface generally used for athletic activities.

Figure 11:
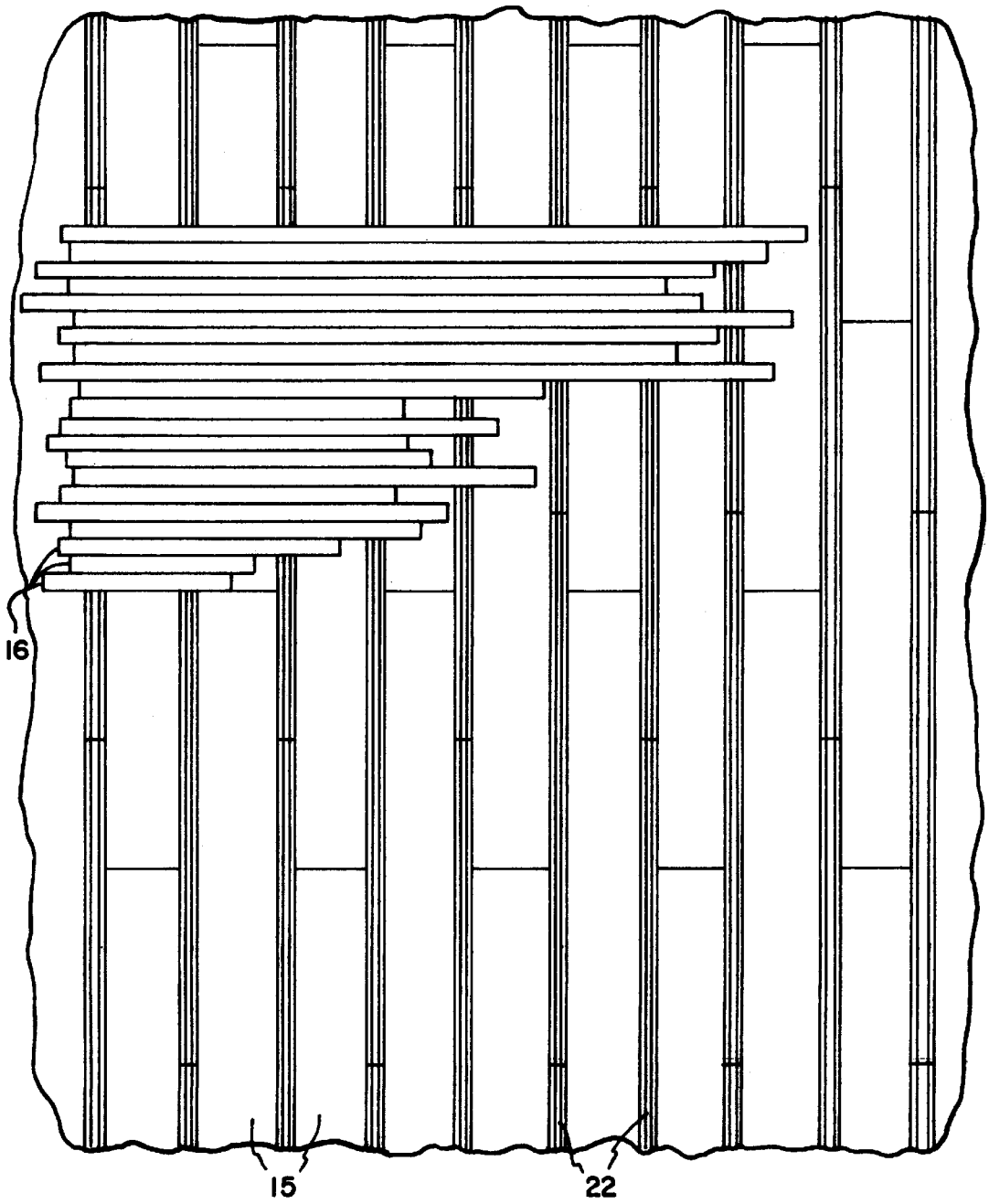
FIG. 11 is a top view of a flooring system employing a subfloor made according to a preferred embodiment of the present invention.

Referring first to FIG. 1 and FIG. 11, the subfloor includes a series of lower plates 14, which support upper resilient sections 15. The lower plates 14 are preferably manufactured from plywood in 8' lengths×8" width×nominal ¾" thickness. The lower plates are preferably aligned in a parallel pattern with each plate 14 spaced 12" on center from adjacent plates 14. Lower plates 14 may be provided in alternate dimensions and material or material combinations than those described above. The spacing of lower plates 14 may also be adjusted as desired to alter performance of floor system.

The upper resilient sections 15 are preferably manufactured of recycled elastomer materials which provide a foam blanket suitable for support below the playing surface 16. The upper resilient sections 15 are preferably provided in 8' lengths×8" width×⅝" thickness. The dimension and type of material provided for the upper resilient section 15 is not limited and may include suitable material and dimensions which provide wanted performance. The upper resilient layer 15 may be attached to the top surface of the lower plates 14 using adhesive, tape, mechanical means or other suitable methods.

Slots 17 are provided along side edges of lower plates 14 to accommodate steel restraining channels 18. Channels 18 are manufactured in what is generally described as a Z shape which includes a upper horizontal flange, lower horizontal flange and vertical wall. The lower horizontal flanges of the channels 18 are inserted into slots 17 of lower plates 14. Retaining screws 19 may be provided through the upper surface of the lower plate 14 to secure the lower horizontal flange of the steel channel 18 into the slot 17 along the side edge of the lower plate 14.

While the channel 18 is preferred to run continuously in the channel slot 17, there is no designated length and the channel 18 may be provided in any length set at any spacing pattern along the side edge of the lower support plate 14. Moreover, while the channel is preferably made of steel, it can be made out of any suitable material, including plastic.

Lower support plates 14 may be anchored directly to typical concrete substrates 20 by providing steel anchors 21 which are typically fastened by powder actuated or air driven tools, or by mechanical means.

The spacing of the lower support plates 14 provides areas for placement of nailers 22, for attachment of the upper playing surface 16. The most preferred design of the nailer 22 includes nailer shoulders 23. The nailer shoulders 23 may be provided by special milling to manufacture the nailers 22 from a single piece of material. Alternatively, the nailer 22 may be manufactured from two separate pieces of material such as a narrower upper section of plywood attached to a wider lower section of plywood to create the nailer shoulders 23 along each edge of the nailers 22.

The nailers 22 are preferably manufactured in an 3½" width narroll with the narrow upper section measuring 2½" wide to provide ½" wide nailer shoulders 23 along the edge of each nailer 22. Preferably the nailer 22 measures nominally ⅞" thick overall and 8' in length.

The dimensions, material composition, and construction of the nailer 22 as described may be altered while staying in the scope of the invention. Optional materials may include solid or composite wood products or non wood products such as plastics hard urethanes or other suitable synthetic materials.

Lower resilient sections 24 are strategically placed below the nailers 22 and on top of the supporting concrete substrate 20. Lower resilient sections 24 may be provided as individual resilient pads periodically spaced below the nailer 22 or as a continuous length running fully below the nailer 22 from end to end. The lower resilient sections 24 typically deflect under significantly lighter loads than those required to deflect the upper resilient section 15. Preferably, this is accomplished in one of two ways, or a combination of both. One, the lower resilient sections 24 may be made out of a material that is substantially softer than that of the upper resilient sections 15, such as closed cell polyethylene foam which allows substantial deflection under light loads. Two, the size of the lower resilient sections may be varied so as to vary the total amount of resilient material underneath each nailer 22. The preferred size of the lower resilient sections measures ½" thick×1½" wide×3½" long.

The combined profile height of the lower resilient section 24 and the nailer shoulder 23 is preferably slightly greater than the dimension between the underside of the upper horizontal flange of the steel channel 18 and the top of the concrete substrate 20. By doing so, a slight compression is created by steel channel 18 against lower resilient section 24 as the adjacent support plates 14 are secured to the concrete substrate 20 by means of the steel anchors 21.

The playing surface 16, which most preferably is provided as hardwood flooring, is attached to the top surface of the nailers 22 by means of staples, nails, adhesive, or other suitable bonding methods. The top surface of the nailers 22 is level with or slightly lower than the top surface of the upper resilient sections 15. By making the top surface of the nailers 22 slightly lower than that of the resilient sections 15, the playing surface will be pressed slightly against resilient sections 15.

Figure 2:
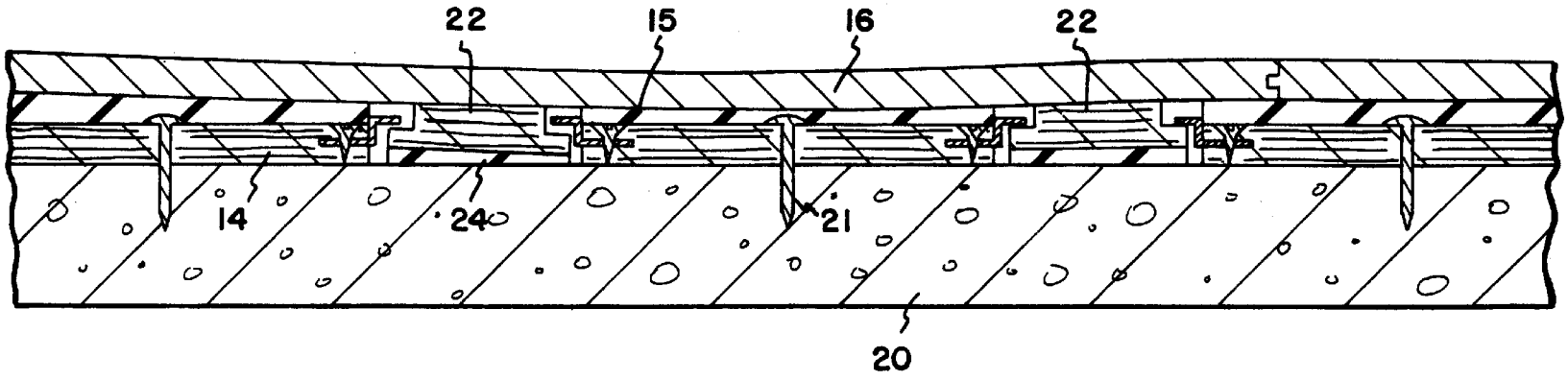
FIG. 2 is sectional view similar to FIG. 1, showing the floor system under athletic load conditions.

FIG. 2 shows the reactions of the floor system upon athletic impact. As the load is applied to the upper playing surface 16 the lower resilient section 24 has no appreciable resistance to the load and deflects easily. This causes the upper resilient section 15 to provide the principal focus of response to surface impacts.

Separation occurs between the top of the nailer shoulder 23 and the underside of the upper horizontal flange of the steel channel 18 as the playing surface 16 is impacted. Contrarily, upward forces associated with environmental reactions are held in check by the containment of the upper horizontal flange of the steel channel 18 on the nailer shoulder 23.

The placement of the upper resilient sections 15 nearest to the playing surface 16 creates the most preferred reaction to athletic impacts. This feature provides the most direct response to surface loads to contain the impact area.

Figure 3:
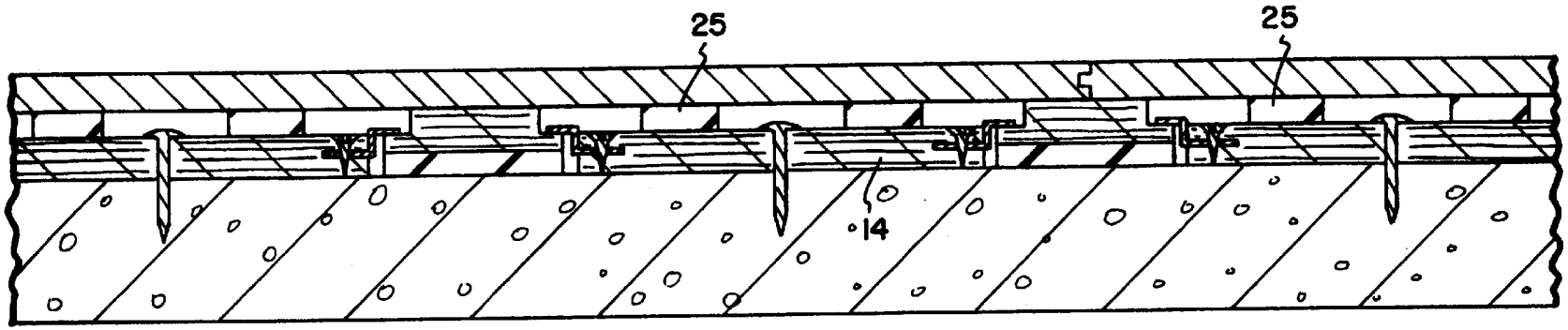
FIG. 3 is a sectional view of a portion of a floor system employing a subfloor made according to a second preferred embodiment of the present invention
Figure 4:
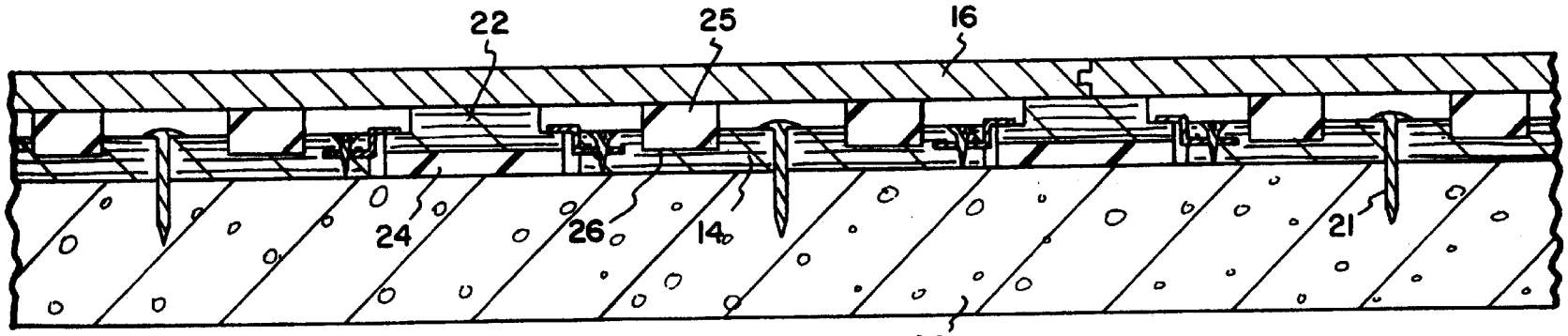
FIG. 4 is a sectional view of a portion of a floor system employing a subfloor made according to a third embodiment of the present invention.

FIGS. 3 and 4 show alternative methods of providing upper resilient sections. As shown in FIG. 3, narrow resilient strips 25 may be provided on top of the lower support plates 14 in lieu of upper resilient sections which align fully on the lower support plate 14. The resilient strips 25 are typically adhered to the upper surface of the support plates 14 with adhesive, tape, or mechanical fasteners.

As shown in FIG. 4, it may be preferable to provide surface recesses 26 in the upper surface of the support plates 14 for receiving the resilient strips 25. This construction allows an increased thickness of the resilient strips 25 in relation to the height of the adjacent nailers 22. Further, the recesses 26 provide a protective area for the resilient strips 25 which can never be fully compressed when the underside of the playing surface 16 deflects fully onto the top of the lower support plate 14. If desired, such recesses may also be provided in the lower surface of nailers 22 so as to limit the compression of the lower resilient elements.

Figure 5:
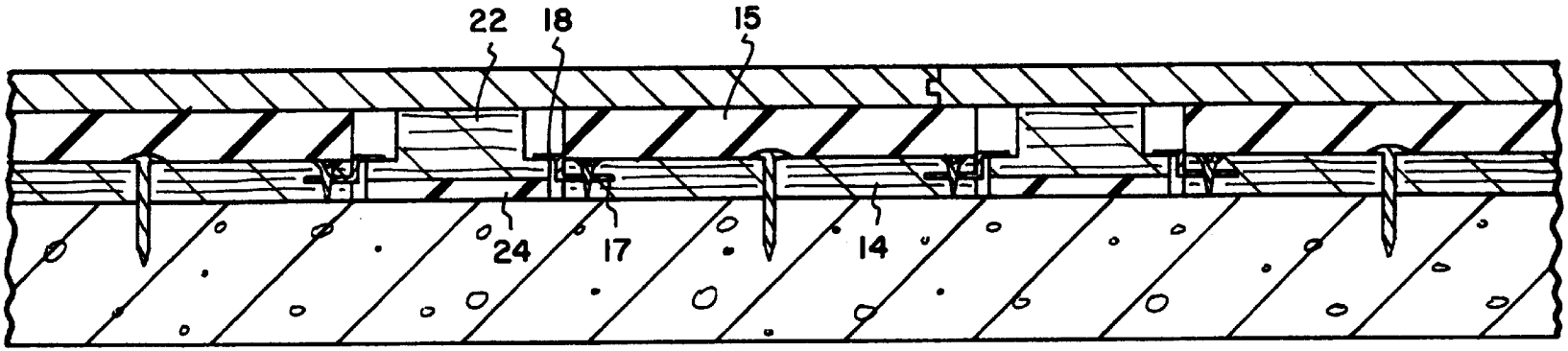
FIG. 5 is a sectional view of a portion of a floor system employing a subfloor made according to a fourth embodiment of the present invention.

FIG. 5 illustrates an option of the invention to adjust performance of the floor system. The upper resilient sections 15 may be increased in thickness. The dimension of the nailer 22 is adjusted accordingly to increase the dimension height above the nailer shoulder 23. These adjustments allow the top surface of the adjusted nailer 22 to align level or slightly lower than the top of the adjusted upper resilient section 15. In the same manner, it is also possible to reduce the thickness of the upper resilient section and of the nailer, without otherwise affecting the construction of the remaining components of the system. Thus, the subfloor system of the preferred embodiments is very versatile, and can be easily adjusted to accommodate a variety of installation requirements.

Figure 6:
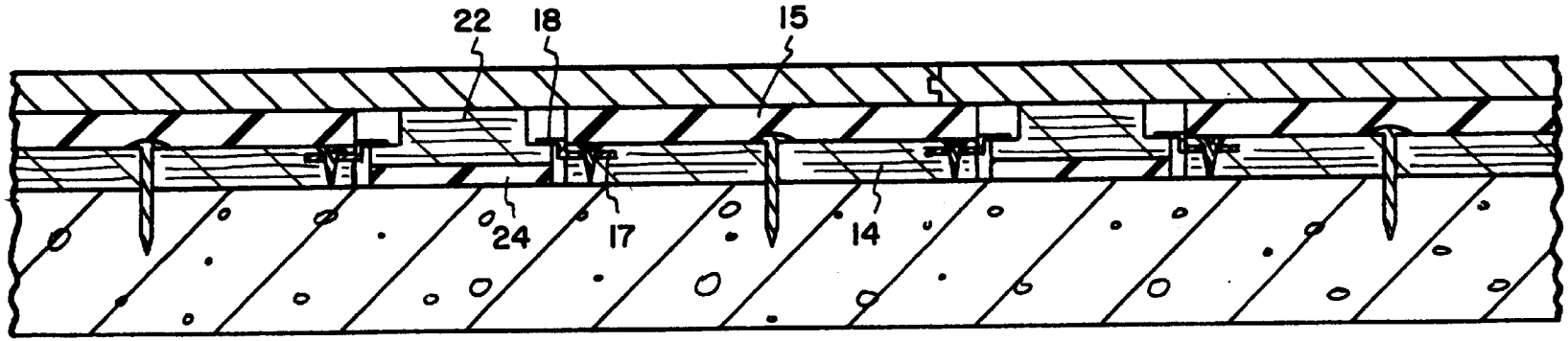
FIG. 6 is a sectional view of a portion of a floor system employing a subfloor made according to a fifth embodiment of the present invention.

FIG. 6 illustrates an alternate manner to increase the thickness of the upper resilient sections 15 and lower resilient sections 24. The channel slots 17 are provided nearer to the top surface of the lower support plates 14. The steel channel 18 aligns higher in relation to the top of the lower support plate 14 than under a normal setting. The upper resilient sections 15 and lower resilient sections 24 are adjusted accordingly to allow proper alignment of the top of the nailer 22 to the top of the upper resilient section 15. This feature allows a profile change in the upper resilient section 15 and lower resilient section 24 without requiring changes in the standard dimensions of the steel channel 18 or nailer 22. Similarly, the channel slots 17 may be provided nearer to the bottom surface of the support plates 14, thus lowering the height of the channel 18. Again, the thickness of the upper and lower resilient member can then be adjusted accordingly.

Figure 7:
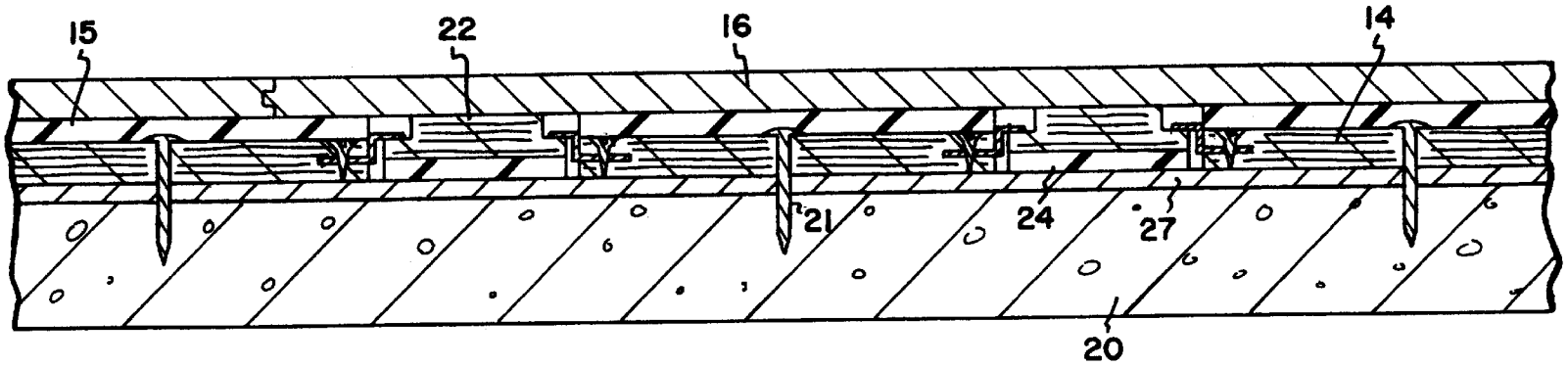
FIG. 7 is a sectional view of a portion of a floor system employing a subfloor made according to a sixth embodiment of the present invention.

FIG. 7 illustrates another embodiment wherein a base plate 27 is attached to the underside of the floor system. The base plate 27 may be attached to the underside of the lower support plates 14 during the manufacturing process by such means as staples, nails, adhesive or other suitable methods. This procedure allows constructing sections of the subfloor system to facilitate shipping and installation procedures. The base plates 27 may consist of strategically placed sections or full sheeting such as 4'×8' dimensions. Steel anchors 21 may still be applied through the lower support plate 14 and base plate 27 to secure the system to the concrete substrate 20.

Figure 8:
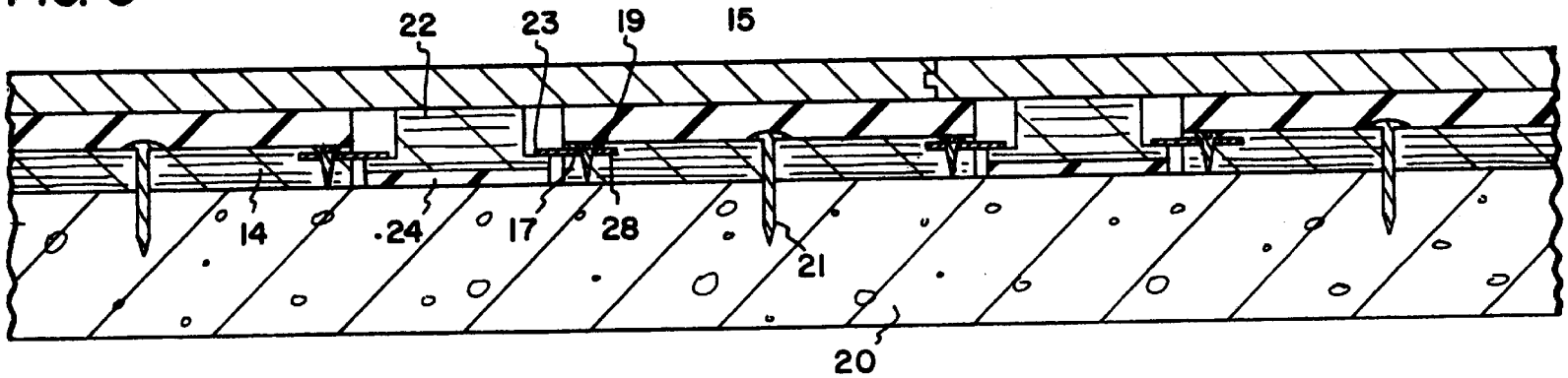
FIG. 8 is a sectional view of a portion of a floor system employing a subfloor made according to a seventh embodiment of the present invention.

FIG. 8 illustrates an embodiment which differs from the embodiment of FIG. 1 in that the channel members are replaced with flat restraining flanges 28 for alignment over nailer shoulders 23. The channel slot 17 is provided in a strategic location in relation to the adjacent nailer 22. Restraining flanges 28, which are preferably made of steel, are inserted into the channel slots 17 and secured to the lower support plates with retaining screws 19 inserted through the surface of the lower support plates 14. The overall dimension of the nailer 22 and profile of the nailer shoulder 23 are adjusted in relation to the thickness of the upper resilient sections 15 and lower resilient sections 24.

Figure 9:
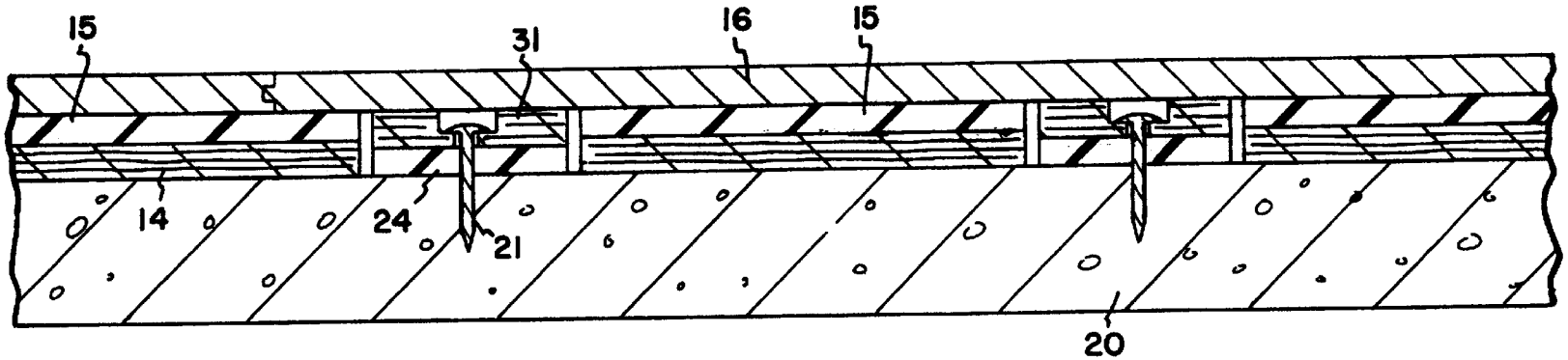
FIG. 9 is a sectional view of a portion of a floor system employing a subfloor made according to a eighth embodiment of the present invention.

FIG. 9 illustrates another manner for introducing upper and lower resilience which falls into the scope of the invention. A nailing section 31 is provided for attachment of the playing surface 16. The nailing section 31 includes lower resilient sections 24. The nailing section 31 preferably includes recesses 32. Steel anchors 21 may be used to secure the nailing sections 31 to the concrete substrate 20, with the head of the anchors located within recesses 32. This arrangement allows for the nailing section 31 to be pressed downwardly under force, but nonetheless limits the upward movement of the nailing sections.

Figure 10:
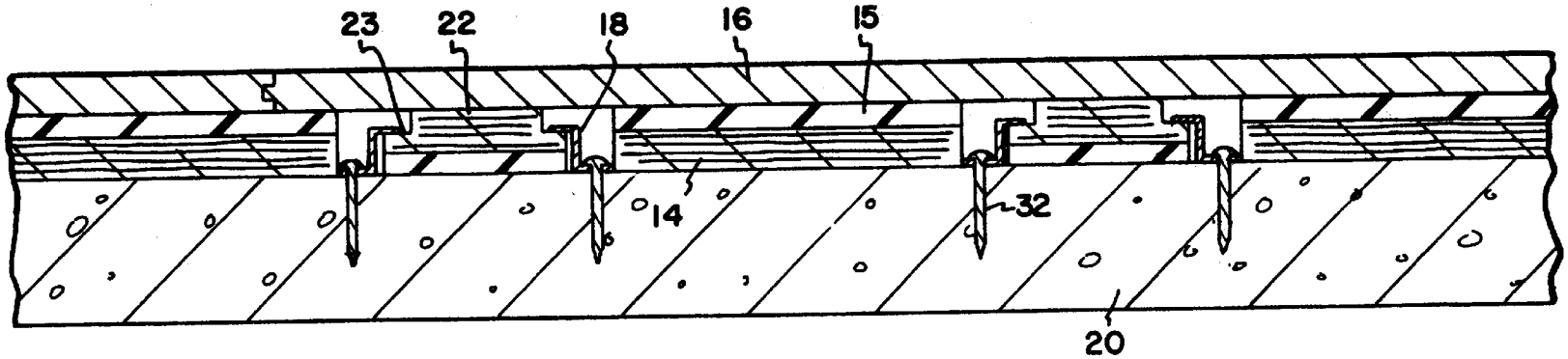
FIG. 10 is a sectional view of a portion of a floor system employing a subfloor made according to a ninth embodiment of the present invention.

FIG. 10 illustrates another alternative embodiment which is modified relative to the embodiment of FIG. 1 to allow direct anchorage of the restraining channel 18 to the concrete substrate 20. In FIG. 10, the restraining channels 18 are fitted between the lower support plates 14 and the nailers 22. Channel pins 32 are inserted through the restraining channels and anchor the channels directly to the concrete substrate 20. The restraining channel 18 is of a dimension which allows the upper horizontal flange to align properly on the top surface of the nailer shoulder 23.

It should also be noted that it may be possible to omit support plates 14 altogether and instead make resilient sections 15 sufficiently thick to fill the entire space between the floor surface and the substrate. In such circumstances, the nailers 22 can be anchored directly to the substrate, as in FIG. 10, or else can remain unattached to the substrate. With such an embodiment, it is particularly important that the lower resilient sections 25 be more easily compressible than the resilient sections 15, so that the majority of the force apply to the floor is borne by the resilient sections 15, and not by the nailers.

As noted above, the upper playing surface 16 is preferably made up of hardwood flooring strips, generally having tongues and grooves to permit interlocking of the flooring strips. However, the subfloor of the present invention is suitable for use with other types of surfaces. Thus, for example, one or more additional subfloor layers may be attached to the nailer 22 of the present invention, followed by a variety of other top materials placed over the additional subfloor layer(s), including poured urethanes, tiles, sheet goods, carpets, parquet flooring, or other suitable surfaces.

The foregoing constitutes a description of the preferred embodiments of the invention. Numerous modifications are possible without departing from the spirit and scope of the invention. The size and relative dimensions of the various elements can be varied where appropriate. The invention can be used with any suitable playing surface. Hence, the scope of the invention should be determined with reference, not to the preferred embodiments, but to the appended claims.

What is claimed is:

1. A subfloor assembly supporting a floor surface on a substrate, comprising:

a plurality of plate members extending longitudinally along the substrate, said plate members extending generally in parallel to one another and being spaced apart so as to define a space between adjacent plate members;

a plurality of sleeper members extending longitudinally along the substrate, said sleeper members being disposed in said spaces between adjacent plate members, each of the sleeper members being made of wood and comprising a shoulder portion that defines an engagement surface located below the upper surface of the sleeper member;

a plurality of first resilient members, at least one of said first resilient members being positioned on an upper surface of each of said plate members;

a plurality of second resilient members, at least one of said second resilient members being positioned below a lower surface of each of said sleeper members; and a plurality of brackets, each of said brackets having an engagement portion that is positioned to engage the engagement surface of one of the sleeper members so as to limit upward movement of the sleeper members;

wherein said floor surface is nailed to an upper surface of said sleeper members.

2. The subfloor assembly as claimed in claim 1, wherein said first resilient members each comprise a sheet of resilient material that covers substantially the entire upper surface of one of the plate members.

3. The subfloor assembly as claimed in claim 1, wherein said first resilient members are resilient pads, wherein a plurality of said resilient pads are positioned on the Upper surface of each plate member.

4. The subfloor assembly as claimed in claim 1, wherein each of said plate members has at least one slot formed in the upper surface thereof for receiving at least one of said first resilient members.

5. The subfloor assembly as claimed in claim 1, wherein said second resilient members each comprise a sheet of resilient material that covers substantially the entire lower surface of one of the sleeper members.

6. The subfloor assembly as claimed in claim 1, wherein said second resilient members are resilient pads, wherein a plurality of said resilient pads are positioned below the lower surface of each sleeper member.

7. The subfloor assembly as claimed in claim 1, wherein each of said sleeper members has at least one slot formed in the lower surface thereof for receiving at least one of said second resilient members.

8. The subfloor assembly as claimed in claim 1, wherein the brackets are generally Z-shaped in transverse cross section.

9. The subfloor assembly as claimed in claim 1, wherein the brackets extend along substantially the entire length of the sleeper members.

10. The subfloor assembly as claimed in claim 1, wherein said first and second resilient members are made of out of a first and a second material, respectively, and wherein said second material is softer than said first material.

11. The subfloor assembly as claimed in claim 1, wherein each of the plate members and the first resilient members have a first combined thickness, wherein each of the sleeper members and the second resilient members have a second combined thickness, and wherein said first combined thickness is greater than said second combined thickness, whereby the first resilient members are held under compression between the floor surface and the plate members.

12. The subfloor assembly as claimed in claim 1, wherein the engagement surface of each bracket is positioned at a predetermined distance above the substrate, and wherein each second resilient member and the shoulder portion of each sleeper member have a combined thickness that is greater than said predetermined distance, whereby the second resilient members are held under compression by the brackets.

13. The subfloor assembly as claimed in claim 1, further comprising a base layer disposed above the substrate and below the plate members and the second resilient members.

14. The subfloor assembly as claimed in claim 1, wherein the plate members are fixed to the substrate.

15. A subfloor assembly supporting a floor surface on a substrate, comprising:

a plurality of support members extending generally in parallel to one another and being spaced apart so as to define a space between adjacent support members, each of said support members comprising a plate member and a first resilient layer disposed on an upper surface of the plate member;

a plurality of attachment members disposed in said spaces between adjacent support members, each of said attachment members comprising a sleeper member and a second resilient layer disposed on a lower surface of the sleeper member, each of the sleeper members being made of wood and comprising a shoulder portion that defines an engagement surface located below the upper surface of the attachment member; and a plurality of brackets for limiting upward movement of the sleeper members, each of said brackets having an engagement portion that is positioned to engage the engagement surface of one of the sleeper members so as to limit upward movement of the sleeper members;

wherein said floor surface is nailed to an upper surface of said attachment members.

16. The subfloor assembly as claimed in claim 15, wherein the brackets are generally Z-shaped in transverse cross section.

17. The subfloor assembly as claimed in claim 15, wherein said first resilient layer comprises a sheet of resilient material that covers substantially the entire upper surface of the plate member.

18. The subfloor assembly as claimed in claim 15, wherein the plate members of each of the support members has at least one slot formed in the upper surface thereof for receiving at least a portion of said first resilient layer.

19. The subfloor assembly as claimed in claim 15, wherein said second resilient layer comprises a sheet of resilient material that covers substantially the entire lower surface of the sleeper member.

20. The subfloor assembly as claimed in claim 15, wherein the sleeper members of each of the attachment members has at least one slot formed in the lower surface thereof for receiving at least a portion of said second resilient layer.

21. The subfloor assembly as claimed in claim 15, wherein said second resilient layers are more compressible than said first resilient layers.

22. The subfloor assembly as claimed in claim 21, wherein said first and second resilient layers are made of out of a first and a second material, respectively, and wherein said second material is softer than said first material.

23. The subfloor assembly as claimed in claim 15, wherein the support members have a first height and the attachment members have a second height, wherein said first height is greater than said second height, whereby the first resilient layers are held under compression between the floor surface and the plate members.

24. The subfloor assembly as claimed in claim 15, wherein the engagement surface of each bracket is positioned at a predetermined distance above the substrate, and wherein the second layer and the shoulder portion of each sleeper member have a combined thickness that is greater than said predetermined distance, whereby the second resilient layers are held under compression by the brackets.

25. A subfloor assembly supporting a floor surface on a substrate, comprising:

a plurality of support members extending generally in parallel to one another and being spaced apart so as to define a space between adjacent support members, each of said support members comprising a first resilient layer disposed underneath, and in contact with, the floor surface;

a plurality of attachment members disposed in said spaces between adjacent support members, each of said attachment members comprising a sleeper member and a second resilient layer disposed on a lower surface of the sleeper member, each of the sleeper members being made of wood and comprising opposing side surfaces and a shoulder portion that defines an engagement surface located below the upper surface of the sleeper member; and a plurality of brackets, each of said brackets being generally Z-shaped in transverse cross-section, and having a first portion that is positioned to engage the engagement surface of one of the sleeper members so as to limit upward movement of the sleeper members, and a second portion that extends generally horizontally outwardly from one of the side surfaces of the one of the sleeper members;

wherein said floor surface is nailed to an upper surface of said attachment members; and wherein said second resilient layers are more compressible than said first resilient layers.

26. The subfloor assembly as claimed in claim 25, wherein said first and second resilient layers are made of out of a first and a second material, respectively, and wherein said second material is softer than said first material.

27. A subfloor assembly supporting a floor surface on a substrate, comprising:

a plurality of plate members extending longitudinally along the substrate, said plate members extending generally in parallel to one another and being spaced apart so as to define a space between adjacent plate members;

a plurality of sleeper members extending longitudinally along the substrate, said sleeper members being disposed in said spaces between adjacent plate members;

a plurality of first resilient members, at least one of said first resilient members being positioned on an upper surface of each of said plate members;

a plurality of second resilient members, at least one of said second resilient members being positioned below a lower surface of each of said sleeper members; and restraining means for limiting upward movement of the sleeper members, said restraining means being attached to the plate members;

wherein said floor surface is attached to an upper surface of said sleeper members.

28. The subfloor assembly as claimed in claim 27, wherein said second resilient members are more compressible than said first resilient members.

29. The subfloor assembly as claimed in claim 28, wherein said first and second resilient members are made of out of a first and a second material, respectively, and wherein said second material is softer than said first material.

30. The subfloor assembly as claimed in claims 27, wherein each of the plate members and the first resilient members have a first combined thickness, wherein each of the sleeper members and the second resilient members have a second combined thickness, and wherein said first combined thickness is greater than said second combined thickness, whereby the first resilient members are held under compression between the floor surface and the plate members.

31. The subfloor assembly as claimed in claim 27, further comprising a base layer disposed above the substrate and below the plate members and the second resilient members.

32. The subfloor assembly as claimed in claim 27, wherein the plate members are fixed to the substrate.

33. A subfloor assembly supporting a floor surface on a substrate, comprising:

a plurality of plate members extending longitudinally along the substrate, said plate members extending generally in parallel to one another and being spaced apart so as to define a space between adjacent plate members, each of the plate members have at least one lateral surface with a slot formed therein;

a plurality of sleeper members extending longitudinally along the substrate, said sleeper members being disposed in said spaces between adjacent plate members, each of the sleeper members comprising a shoulder portion that defines an engagement surface located below the upper surface of the sleeper member;

a plurality of first resilient members, at least one of said first resilient members being positioned on an upper surface of each of said plate members;

a plurality of second resilient members, at least one of said second resilient members being positioned below a lower surface of each of said sleeper members; and restraining means for limiting upward movement of the sleeper members, said restraining means comprising a plurality of brackets, each of said brackets having an engagement portion that is positioned to engage the engagement surface of one of the sleeper members, wherein a portion of each of the brackets is restrained within one of said slots;

wherein said floor surface is attached to an upper surface of said sleeper members.

34. The subfloor assembly as claimed in claim 33, wherein the brackets are generally Z-shaped in transverse cross section.

35. The subfloor assembly as claimed in claim 33, wherein the brackets extend along substantially the entire length of the sleeper members.

36. The subfloor assembly as claimed in claim 33, wherein said second resilient members are more compressible than said first resilient members.

37. The subfloor assembly as claimed in claim 36, wherein said first and second resilient members are made of out of a first and a second material, respectively, and wherein said second material is softer than said first material.

38. The subfloor assembly as claimed in claim 33, wherein each of the plate members and the first resilient members have a first combined thickness, wherein each of the sleeper members and the second resilient members have a second combined thickness, and wherein said first combined thickness is greater than said second combined thickness, whereby the first resilient members are held under compression between the floor surface and the plate members.

39. The subfloor assembly as claimed in claim 33, wherein the engagement surface of each bracket is positioned at a predetermined distance above the substrate, and wherein each second resilient member and the shoulder portion of each sleeper member have a combined thickness that is greater than said predetermined distance, whereby the second resilient members are held under compression by the brackets.

40. The subfloor assembly as claimed in claim 33, further comprising a base layer disposed above the substrate and below the plate members and the second resilient members.

41. The subfloor assembly as claimed in claim 33, wherein the plate members are fixed to the substrate.

42. A subfloor assembly supporting a floor surface on a substrate, comprising:

a plurality of support members extending generally in parallel to one another and being spaced apart so as to define a space between adjacent support members, each of said support members comprising a plate member and a first resilient layer disposed on an upper surface of the plate member;

a plurality of attachment members disposed in said spaces between adjacent support members, each of said attachment members comprising a sleeper member and a second resilient layer disposed on a lower surface of the sleeper member, each of the sleeper members comprising a shoulder portion that defines an engagement surface located below the upper surface of the attachment member; and a plurality of brackets, each of said brackets having an engagement portion that is positioned to engage the engagement surface of one of the sleeper members so as to limit upward movement of the sleeper members;

wherein each of the plate members have at least one lateral surface with a slot formed therein, and a portion of each of the brackets is restrained within one of said slots; and wherein said floor surface is attached to an upper surface of said attachment members.

43. The subfloor assembly as claimed in claims 42, wherein the brackets are generally Z-shaped in transverse cross section.

44. The subfloor assembly as claimed in claim 42, wherein said first resilient layer comprises a sheet of resilient material that covers substantially the entire upper surface of the plate member.

45. The subfloor assembly as claimed in claim 42, wherein the plate members of each of the support members has at least one slot formed in the upper surface thereof for receiving at least a portion of said first resilient layer.

46. The subfloor assembly as claimed in claim 42, wherein said second resilient layer comprises a sheet of resilient material that covers substantially the entire lower surface of the sleeper member.

47. The subfloor assembly as claimed in claim 42, wherein the sleeper members of each of the attachment members has at least one slot formed in the lower surface thereof for receiving at least a portion of said second resilient layer.

48. The subfloor assembly as claimed in claim 42, wherein said second resilient layers are more compressible than said first resilient layers.

49. The subfloor assembly as claimed in claim 48, wherein said first and second resilient layers are made of out of a first and a second material, respectively, and wherein said second material is softer than said first material.

50. The subfloor assembly as claimed in claim 42, wherein the support members have a first height and the attachment members have a second height, wherein said first height is greater than said second height, whereby the first resilient layers are held under compression between the floor surface and the plate members.

51. The subfloor assembly as claimed in claim 42, wherein the engagement surface of each bracket is positioned at a predetermined distance above the substrate, and wherein the second layer and the shoulder portion of each sleeper member have a combined thickness that is greater than said predetermined distance, whereby the second resilient layers is held under compression by the brackets.

* * * * *